US008016119B2

(12) United States Patent
Legtenberg et al.

(10) Patent No.: US 8,016,119 B2
(45) Date of Patent: Sep. 13, 2011

(54) APPARATUS AND METHOD FOR SEPARATING PLASTIC FILM FROM WASTE

(75) Inventors: Hermannus Johannes Maria Legtenberg, Winschoten (NL); Hendrik Huibert Witting, Harkstede (NL)

(73) Assignee: Machinefabriek Bollegraaf Appingedam B.V., Appingedam (NL)

( * ) Notice: Subject to any disclaimer, the term of this patent is extended or adjusted under 35 U.S.C. 154(b) by 576 days.

(21) Appl. No.: 12/049,794

(22) Filed: Mar. 17, 2008

(65) Prior Publication Data

US 2008/0223770 A1 Sep. 18, 2008

Related U.S. Application Data

(60) Provisional application No. 60/918,194, filed on Mar. 15, 2007.

(51) Int. Cl.
*B07C 5/36* (2006.01)

(52) U.S. Cl. ..... 209/616; 209/615; 209/644

(58) Field of Classification Search ..... 209/615, 209/616, 643, 644, 707, 932
See application file for complete search history.

(56) References Cited

U.S. PATENT DOCUMENTS

| | | | | |
|---|---|---|---|---|
| 770,311 | A * | 9/1904 | Plummer | 209/607 |
| 4,067,506 | A | 1/1978 | Cerroni | |
| 4,207,986 | A | 6/1980 | Cerroni | |
| 4,232,506 | A * | 11/1980 | Studer | 56/327.1 |
| 4,438,851 | A * | 3/1984 | Voelskow | 209/616 |
| RE32,823 | E * | 1/1989 | Dahlby | 209/616 |
| 5,123,543 | A * | 6/1992 | Stimpfl | 209/616 |
| 6,003,680 | A | 12/1999 | Finn | |
| 6,241,097 | B1 | 6/2001 | Roman | |
| 6,257,978 | B1 * | 7/2001 | Meester | 460/145 |
| 6,394,280 | B1 | 5/2002 | Gassner et al. | |

FOREIGN PATENT DOCUMENTS

| | | | |
|---|---|---|---|
| DE | 92 18 369 | U1 | 2/1994 |
| DE | 198 03 325 | A1 | 9/1999 |
| EP | 0 050 259 | A2 | 4/1982 |
| EP | 0876959 | B1 | 11/1998 |
| EP | 1 105 222 | B1 | 6/2001 |
| EP | 1 676 645 | A1 | 7/2006 |
| JP | 54 022 477 | A | 2/1979 |
| JP | 7 275 800 | A | 10/1995 |
| JP | 90 85 179 | A | 3/1997 |
| JP | 11 090 407 | A | 4/1999 |
| JP | 2000 005 703 | A | 1/2000 |
| JP | 2000 140 766 | A | 5/2000 |
| JP | 2006 167653 | A | 6/2006 |

OTHER PUBLICATIONS

European Patent Office, "European Search Report", issued Sep. 3, 2007 in corresponding Appl. No. EP 07104284, pp. 1-7.

* cited by examiner

*Primary Examiner* — Joseph C Rodriguez
(74) *Attorney, Agent, or Firm* — Pearne & Gordon LLP

(57) ABSTRACT

In an apparatus for separating plastic film material from waste, a plurality of hooks is mounted on a hook carrier for circulating the hooks along a trajectory through an engagement area near a supply track and through a disengagement area downstream of the engagement area. The engagement area is located higher than the supply track and/or in supply direction beyond the downstream end of the supply track, such that, in operation, a remainder of the waste passes by the trajectory of the hooks without contacting the hooks. The hooks project from the drum via openings in the circumferential surface of the drum and are retractable into a circumferential surface of the drum. A method for separating plastic film material from waste is also described.

6 Claims, 3 Drawing Sheets

APPARATUS AND METHOD FOR SEPARATING PLASTIC FILM FROM WASTE

This application claims the benefit of U.S. Provisional Patent Application No. 60/918,194 filed Mar. 15, 2007, the entire contents of which is hereby incorporated by reference.

FIELD AND BACKGROUND OF THE INVENTION

The invention relates to an apparatus and a method for separating plastic film material from waste. Waste, other than specific types of industrial or agricultural waste generally contains substantial amounts of flexible plastics, such as film material of garbage bags and packaging material. For an effective recycling of plastic material, it is desirable to have such plastic film waste separated from the other waste. For the processing of categories of waste, it is desirable that the waste contains no or very little plastic film material.

In U.S. Pat. No. 4,067,506, Japanese patent application publ. No. 54 022 4777, European patent application 0 050 259 and U.S. Pat. No. 6,241,097, apparatuses are disclosed in which plastic film material is separated from waste by bringing waste in contact with circulating hooks that engage plastic film material more than other material brought in contact with the hooks. The circulating hooks displace engaged film material away from the other waste and the engaged film material is subsequently disengaged from the hooks and transported away for further processing and storage.

In these apparatuses, a stream of waste from which plastic film material is to be separated is caused to come in contact with the hooks by causing the waste to drop or slide to the hooks under the influence of gravity.

SUMMARY OF THE INVENTION

It is an object of the invention to achieve an effective separation of film material efficiently, by effectively engaging and disengaging film materials.

According to the invention, this object is achieved by providing an apparatus for separating plastic film material from waste, having:

a supply track for supplying waste, the supply track extending in a supply direction to its downstream end; and a plurality of hooks mounted on a drum for circulating the hooks along a trajectory through an engagement area near the supply track and through a disengagement area downstream of the engagement area;

wherein the engagement area is located higher than the supply track and/or in the supply direction beyond the downstream end of the supply track, such that, in operation, a remainder of the waste passes by the trajectory of the hooks without contacting the hooks; and wherein the hooks project from the drum via openings in the circumferential surface of the drum and are retractable into a circumferential surface of the drum.

The invention may also be embodied in a method for separating plastic film material from waste, in which waste is supplied along a supply track in a supply direction and a plurality of hooks are circulated along a trajectory through an engagement area near the supply track and through a disengagement area, wherein, in each rotation of the drum, the hooks are extended from the drum into positions projecting via openings in the circumferential surface of the drum and are retracted into the circumferential surface of the drum.

Since the hooks that are rotated along with the drum are retracted, no separate members for stripping caught film material are required and the construction can be relatively light and simple and is suitable for rotation at relatively high rotational speeds. Moreover, the openings in the drum via which the hooks project and are retracted only need to be small so that the inside of the drum can be well shielded from the waste material. Particular embodiments of the invention are set forth in the dependent claims.

Further features, effects and details of the invention are described with reference to an example shown in the drawings.

DETAILED DESCRIPTION

Figure 1:
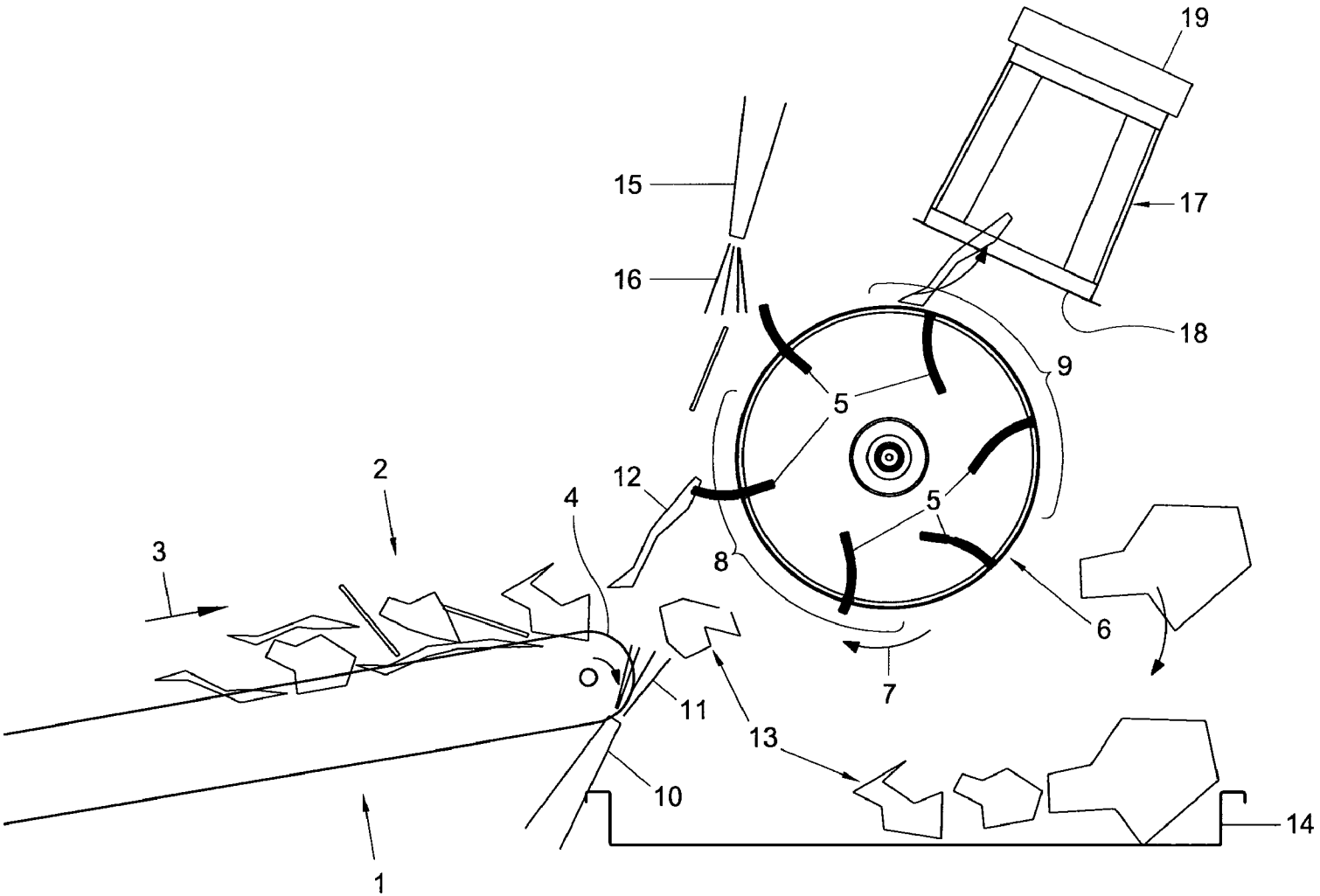
FIG. 1 is a schematic side view of an example of an apparatus according to the invention.

The invention is first described with reference to the example shown in the drawings and the various alternative options within the framework of the invention are discussed.

The apparatus shown in the drawings is equipped with a supply track 1 for supplying waste. The supply track 1 extends in a supply direction (arrow 3) to a downstream end 4 thereof.

Hooks 5 are mounted on a hook carrier in the form of a drum 6 for circulating the hooks 5 in a sense of circulation (arrow 7) along a trajectory through an engagement area 8 near the supply track 1 and through a disengagement area 9 downstream of the engagement area 8.

A blower 10 is arranged for generating an upward airflow 11 in the vicinity of the downstream end 4 of the supply track 1 for blowing a fraction 12 of the waste 2 to the hooks 5 in the engagement area 8 (in the drawings only one hook 5 of a plurality of hooks in a row in axial direction of the drum 6 is visible).

The engagement area 8 is located higher than the supply track and in the supply direction 3 beyond the downstream end 4 of the supply track 1, such that, in operation, a remainder 13 of the waste 2 is passed by the trajectory of the hooks 5 without contacting the hooks 5.

Underneath the downstream end 4 of the supply track 1, the engagement area 8 and the disengagement area 9, a discharge conveyor 14 is arranged for transporting away the remainder 13 of the waste 2.

In operation, waste 2 is supplied along the supply track 1 in the supply direction 3 while the hooks 5 are circulated along a trajectory through the engagement area 8 and the disengagement area 9. The upward airflow 11, which does not need to be vertically upward, but may just have an upward directional component as in the present example, in the vicinity of the downstream end 4 of the supply track 1 causes the fraction 12 of the waste 2, which is easily entrained by an airflow and contains the plastic film material, to be diverged to the hooks 5 in the engagement area 8. The remainder 13 of the waste 2 passes by the hooks 5 without contacting the hooks 5.

By the upward airflow 11, a fraction 12 of the waste 2 that is easily entrained by an airflow, such as sheet material, is separated from the waste 2 and blown against the hooks 5 in the engagement area 8. Thus, in a simple manner a fraction 12 of the waste 2 containing the plastic sheet material is separated from the remainder 13 of the waste 2 and brought in contact with the hooks 5, where the relatively flexible plastic sheet material is engaged by the hooks 5 and other material, such as paper, is not engaged by the hooks 5 and allowed to drop back once it is outside the upward airflow 11. The remainder 13 of the waste does not contact the hooks 5 and is thus prevented from interfering with the procedure of sorting out plastic film material on the basis of its propensity to be engaged by the hooks 5 and drops onto the discharge conveyor 14.

According to the present example, the engagement area 8 is located closely beyond the downstream end 4 of the supply track 1. Furthermore, the blower 10 is arranged for generating the upward airflow 11 in the vicinity of the downstream end 4 of the supply track 1 and the engagement area 8 is located higher than the supply track 1 and in the supply direction 3 beyond the downstream end 4 of the supply track 1, such that, in operation, the remainder 13 of the waste drops from the downstream end 4 of the supply track 1 without contacting the hooks 5.

In the vicinity of the downstream end 4 of the supply track 1, and in particular downstream of the supply track 1, the upward airflow 11 is disturbed very little by the structure of the supply track and the easily entrained fraction 12 of the waste 2 separates out relatively easily from the remainder of the waste, because, in the stream of waste falling freely from the downstream end of the supply track 1, the waste to be entrained by the airflow is not clamped underneath other waste.

The easily entrained fraction 12 of the waste 2 will generally not only contain plastic film material, but also other thin walled materials, such as paper and cardboard. To counteract that such materials are also engaged by the hooks 5, the apparatus according to the present example is further equipped with a blower 15 for generating a counter airflow 16 along the hooks 5 in and downstream of the engagement area 8. The counter airflow 16 is directed in a direction with a component opposite to the direction of movement of the hooks through that airflow in and downstream of the engagement area 8 and blows material that is not effectively hooked-on by the hooks 5 off the hooks 5, so that at least a substantial portion of the paper and other non-plastic film material that initially clings to the hooks 5 is removed from the hooks 5 before it is entrained by the hooks 5 for processing with the plastic film material. As in the present example, the counter airflow 16 is preferably directed with a downward component.

The fraction 12 of the waste that is easily entrained by an airflow and that is hooked by one or more of the hooks 5 may be composed of not only plastic film material but also of other materials clinging to or held in the plastic film materials. For instance a garbage bag containing some garbage may be effectively hooked by the hooks 5. However, such impurities in the stream of sorted plastic film material may disturb the further processing of the sorted plastic film material.

To reduce the amounts of impurities in the sorted plastic film material, it is provided according to the present example, that the apparatus is equipped with a discharge channel 17 having an inlet 18 above the disengagement area 9 and with a ventilator 19 for generating an airflow through the disengagement area 9 towards the inlet 18 and through the discharge channel 17. Because the plastic film material is removed from the hooks 5 by generating an airflow through the disengagement area 9 and towards and through the discharge channel 17, items of plastic film material that hold or are connected to substantial amounts of impurities, such as garbage bags that contain at least some waste, will generally be too heavy to be entrained by the suction applied via the discharge channel 17. Such heavy items therefore drop down onto the discharge conveyor 14 and are not discharged with the sorted plastic film material.

Figure 2:
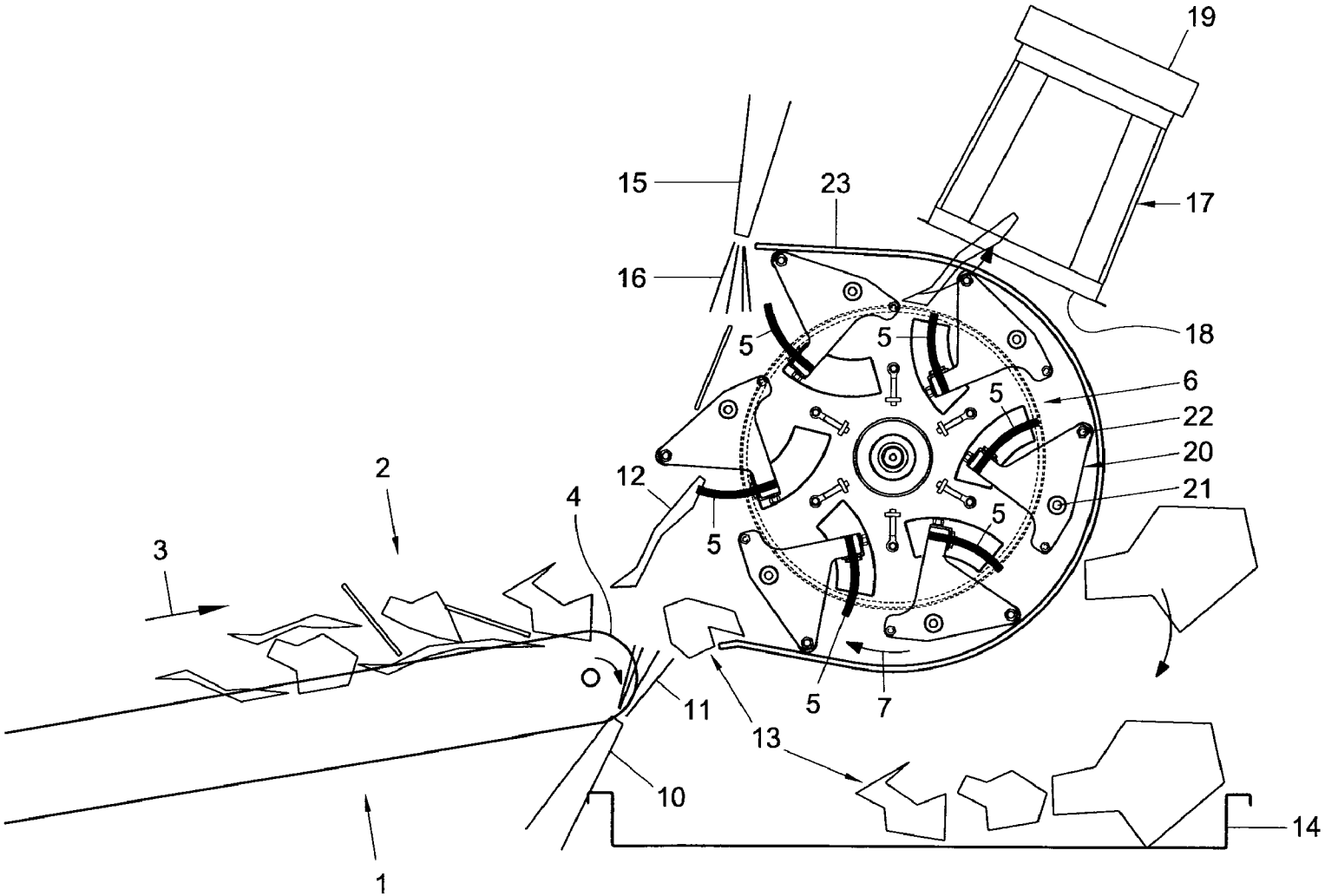
FIG. 2 is a schematic side view in cross-section of the apparatus shown in FIG. 1.

As is shown in FIG. 2, the hooks 5 project from the drum 6 via openings in the circumferential surface of the drum 6 and are retractable into a circumferential surface of the drum. By retracting the hooks in the disengagement area 9, disengagement of the material hooked onto the hooks is facilitated by stripping of the caught film material from the hooks. Furthermore, winding of waste material around the circulating hooks is prevented. Since the hooks 5 that are rotated along with the drum 6 are retracted, no separate members for stripping caught film material are required and the construction can be relatively light and simple and is suitable for rotation at relatively high rotational speeds. Moreover, the openings in the drum 6 via which the hooks 5 are retracted only need to be small so that the inside of the drum 6 is well shielded from the waste material.

To achieve and operate the retractability of the hooks, the hooks 5 are mounted to the drum 6 via double lever members 20, of which only one is designated by a reference numeral. Each time a row of hooks 5 extending in axial direction of the drum is carried by a pair of the double lever members that are mounted on opposite end faces of the drum 6 and are pivotable relative to the drum 6 about axes 21. Cam followers 22 are positioned for engagement by cam profiles 23 that are arranged axially outside of the drum 6. When a row of hooks 5 enters the disengagement area 9, the associated cam followers 22 contact the cam profile 23 and pushes the cam follower radially inwardly towards the axis of the drum as the cam follower moves along the cam profile 23. This causes the associated double levers 20 to pivot relative to the drum 6, so that the associated hooks 5 are retracted into the drum 6. When a row of hooks 5 approaches the engagement area 8, the associated cam followers 22 reach a section of the cam profile 23 of which the radial distance to the axis of the drum 6 increases in the rotational sense 7, so that the cam follower 22 is again allowed to move away from the axis of the drum 6 and does so under influence of springs (not shown) that bias the double lever members 20 into positions in which the hooks 5 project maximally from the drum 6. Because the hooks 5 are extended while moving through the engagement area 8 where the material 12 that is to be engaged selectively reaches the circulation path of the hooks 5, effective and selective engagement of film material by the hooks 5 is enhanced, because the hooks are to some extent "stabbed" into the film material to be engaged. Since the hooks 5 project from the drum 6 in the sense of circulation, extending the hooks 5 also causes the velocity of the hooks 5 in circumferential sense of the drum 6 to be increased temporarily, which is advantageous for more effectively engaging film material. A further advantage of extending the hooks 5 relatively late is that the likelihood that heavier material 13 that drops along the drum 6 is hit or caught by the hooks is reduced and/or the stream of heavier material passing 13 along the drum 6 can pass more closely along the drum 6.

The hooks 5 are curved about the pivot axes 21, so that narrowly fitting openings (gap width preferably smaller than 0.5 cm) in the circumference of the drum 6 are sufficient to allow the hooks to be extended and retracted. Because moreover the pivot axes are positioned forwardly in the sense of rotation 7 of the drum 6, the hooks 5 are curved in the sense of rotation 5, which is advantageous for reliably engaging plastic film material.

While the invention is described above with reference to an example, it will be readily apparent to the skilled person that within the framework of the inventions, many variants are conceivable. For instance, the hooks may be only partially retractable or not retractable at all.

Also, the discharge channel 17 for removing plastic film material from the hooks 5 by suction may be dispensed with, for instance if the purpose of removing plastic film material is mainly to clear the remainder of the waste from plastic film material. If the discharge channel 17 for removing plastic film material from the hooks 5 by suction is dispensed with, it is preferred that a separate discharge conveyor or chute is arranged for separately collecting and discharging all materials that have passed over the drum, for instance under a portion of the circumference of the drum facing away from the supply track.

The supply track 1 is in the form of a conveyor belt, but may also be provided in another form, such as in the form of a chute or a screw conveyor.

The engagement area where plastic film material is brought in contact with the hooks and engaged by the hooks may be positioned above the supply track instead of downstream of the downstream end 4 of the supply track 1 as shown in the present example. In such an embodiment, the blower for generating an upward airflow for blowing a fraction of the waste that is easily entrained by an airflow against the hooks will be located more upstream than in the example shown to blow through supply track. Separation of the easily entrained fraction of the waste may be facilitated by including agitators for agitating waste lying on the supply track in the area of the upward airflow.

The trajectory along which the hooks can be circulated does not need to be circular, but may for instance have an elongate shape, for instance by providing that the hooks are carried by a conveyor chain.

Figure 3:
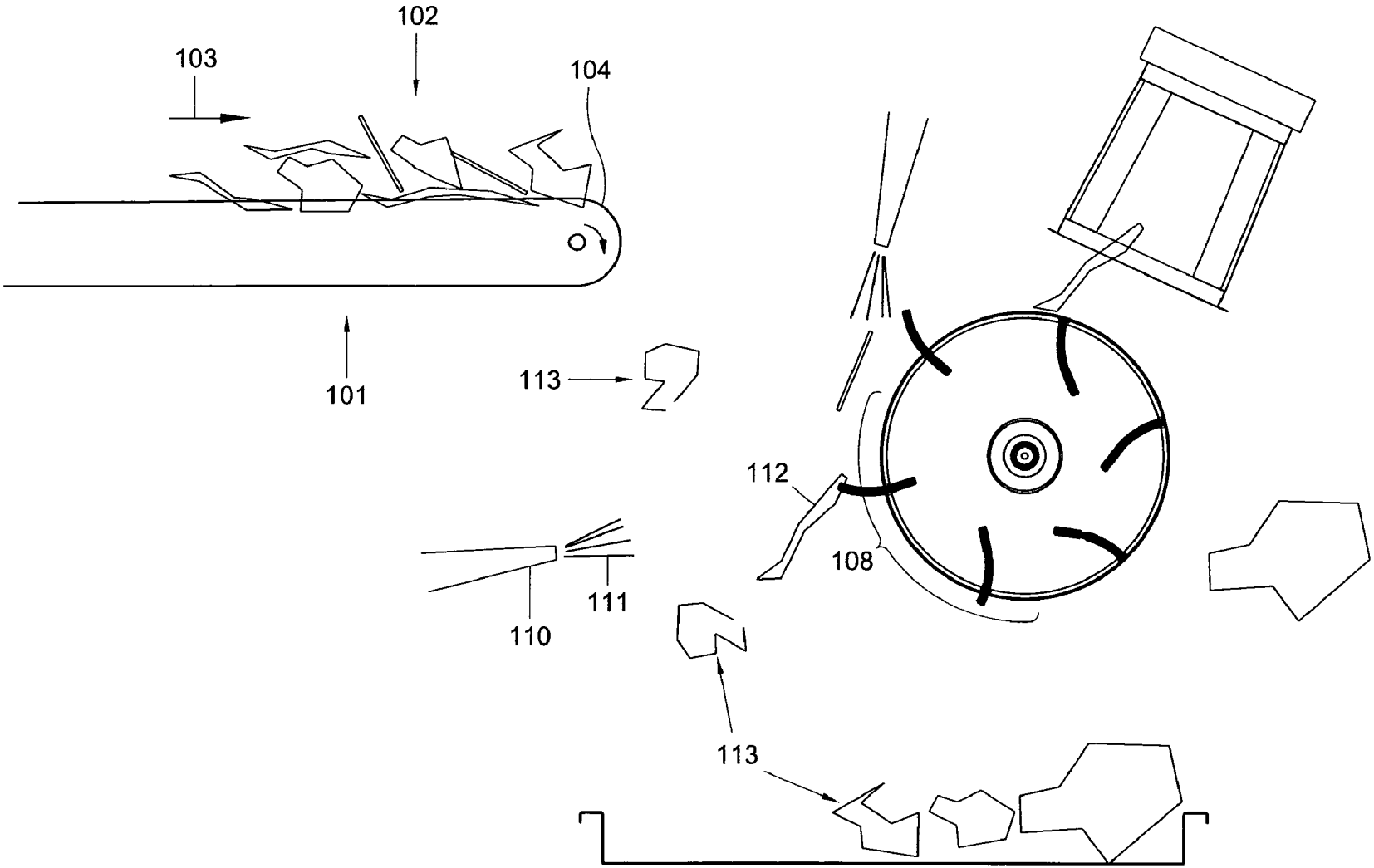
FIG. 3 is a schematic side view of an alternative example of an apparatus according to the invention.

FIG. 3 shows an alternative example an apparatus according to the invention, wherein an engagement area 108 is located in a supply direction 103 beyond and below a downstream end 104 of a supply track 101. A blower 110 is arranged for blowing an easily entrained fraction 112 of waste 102 with a horizontal airflow 111 out of a stream of waste that drops from the downstream end 104 of the supply track 101. The easily entrained fraction 112 of the waste is blown against hooks in the engagement area 108. The remainder 113 of the waste drops further without contacting the hooks.

The invention claimed is:

1. An apparatus for separating plastic film material from waste, comprising:

a supply track for supplying waste, the supply track extending in a supply direction to its downstream end; and a plurality of hooks mounted on a drum for circulating the hooks along a trajectory through an engagement area near the supply track and through a disengagement area downstream of the engagement area;

wherein the engagement area is located higher than the supply track and/or in said supply direction beyond the downstream end of the supply track, such that, in operation, material that is to be engaged selectively reaches the trajectory of the hooks in the engagement area, and a remainder of the waste passes by the trajectory of the hooks without contacting the hooks; and wherein the hooks project from the drum via openings in the circumferential surface of the drum and are retractable into a circumferential surface of the drum, wherein the hooks are coupled to the drum so as to be extended while moving through the engagement area; and wherein the hooks are mounted to the drum via double lever members that are pivotable relative to the drum and carry cam followers positioned for engagement by cam profiles that are arranged axially outside of the drum.

2. An apparatus according to claim 1, wherein the cam profile is shaped such that when a row of hooks approaches the engagement area, the associated cam followers reach a section of the cam profile of which the radial distance to the axis of the drum increases in rotational sense, for allowing the cam follower to move away from the axis of the drum.

3. An apparatus according to claim 1, wherein the hooks are curved about pivot axes about which the respective double lever members are pivotable relative to the drum.

4. An apparatus according to claim 3, wherein pivot axes about which the respective double lever members are pivotable relative to the drum are positioned forwardly in the sense of rotation of the drum.

5. An apparatus according to claim 1, further comprising a blower arranged for generating an upward airflow through the supply track and/or in the vicinity of the downstream end of the supply track for blowing a fraction of the waste to the hooks in the engagement area.

6. An apparatus according to claim 1, wherein the engagement area is located closely beyond the downstream end of the supply track, wherein the blower is arranged for generating the upward airflow in the vicinity of the downstream end of the supply track and wherein the engagement area is located higher than the supply track and/or in said supply direction from the downstream end of the supply track, such that, in operation, the remainder of the waste drops from the downstream end of the supply track without contacting the hooks.

* * * * *